US006134408A

United States Patent [19]

Kataoka et al.

[11] Patent Number: 6,134,408

[45] Date of Patent: Oct. 17, 2000

[54] CHARGING MEMBER AND CHARGING APPARATUS

[75] Inventors: Hiroyuki Kataoka; Hiroyuki Miura; Hiroshi Takayama, all of Minamiashigara, Japan

[73] Assignee: Fuji Xerox Co., Ltd., Tokyo, Japan

[21] Appl. No.: 09/386,443

[22] Filed: Aug. 31, 1999

[30] Foreign Application Priority Data

Sep. 28, 1998 [JP] Japan ..... 10-273990

[51] Int. Cl.[7] ..... G03G 15/02

[52] U.S. Cl. ..... 399/176; 361/225

[58] Field of Search ..... 399/174, 176; 361/225, 230, 221

[56] References Cited

U.S. PATENT DOCUMENTS

| | | | |
|---|---|---|---|
| 5,390,007 | 2/1995 | Kugoh et al. | 399/176 |
| 5,766,753 | 6/1998 | Murata et al. | 399/176 X |
| 6,067,430 | 5/2000 | Mammino et al. | 399/174 |

FOREIGN PATENT DOCUMENTS

| | | |
|---|---|---|
| 8-15960 | 1/1996 | Japan . |
| 8-220840 | 8/1996 | Japan . |
| 2649163 | 5/1997 | Japan . |
| 9-146346 | 6/1997 | Japan . |
| 10-69151 | 3/1998 | Japan . |
| 10-148997 | 6/1998 | Japan . |

*Primary Examiner*—Susan S.Y. Lee
*Attorney, Agent, or Firm*—Oliff & Berridge, PLC

[57] ABSTRACT

The invention is to suppress a fluctuation in resistance of a charging member due to the environment and the applied voltage, and to suppress the charging potential of a photosensitive article to realize uniformity in charging by preventing generation of leakage at a part of a low resistance on the surface of the photosensitive article. The charging member may have a conductive core material, a conductive elastic layer formed on a surface of the conductive core material, and a resistance adjusting layer for adjusting a resistance between the conductive core material and the surface of the article to be charged, formed on a surface of the conductive core material, have a material for forming the resistance adjusting layer and a conductive filler for adjusting resistance that exhibits conductivity by electronic conduction, and having a volume resistivity of $5\times10^5$ Ω·cm or more at an electric field of $5\times10^4$ V/cm.

20 Claims, 4 Drawing Sheets

CHARGING MEMBER AND CHARGING APPARATUS

BACKGROUND OF THE INVENTION

1. Field of the Invention

The present invention relates to a charging member for charging an article to be charged, such as a photosensitive article used for electrophotography and a static charge recording process in an image forming apparatus, such as an electrophotographic duplicator and a printer. More specifically, the invention relates to a charging member for charging the surface of an article to be charged, such as a photosensitive article and a dielectric article, by contacting the surface of the article to be charged.

2. Description of the Related Art

In an image forming apparatus using the electrophotographic process, it is generally conducted that the surface of an article to be charged, such as a photosensitive article and a dielectric article, is subjected to a uniform charging treatment. As means for the charging treatment, a method of charging by corona discharge formed by applying a high voltage to a metallic wire is generally employed. However, the method using corona discharge involves a problem in that it causes modification of the surface of the photosensitive article due to a corona product formed on charging, such as ozone and nitrogen oxide ($NO_x$), which brings about deterioration of the photosensitive article and image blur, and contamination of the wire influences the image quality to form white spots and black lines in the image.

As compared with then on-contact charging method described above, there is a contact charging method, in which a charging treatment is conducted by making a charging member into contact with an article to be charged. The non-contact charging method has the advantage that a voltage applied to the charging member is generally low, and thus the amount of ozone formed is extremely small.

FIG. 3 is a diagram showing a charging roll for charging the surface of a photosensitive article by the contact charging method.

In FIG. 3, a drum 01 of a photosensitive article comprises a cylindrical member 02 comprising aluminum, and a photosensitive layer 03 formed on the surface of the cylindrical member 02. The photosensitive layer 03 has a high volume resistivity (for example, $10^{14}$ Ω·cm or more) and a thickness of about from 5 to 100 μm.

A charging roll 05 in contact with the surface of the drum 01 of the photosensitive article comprises a core material 06 comprising aluminum, a semiconductive elastic layer 07 formed on the surface of the core material 06, and a resistance adjusting layer 08 formed on the semiconductor elastic layer 07.

The semiconductive elastic layer 07 is a layer for adjusting the hardness of the surface of the charging roll 05, and has, for example, a thickness of about 2 mm and a volume resistivity of about from $10^5$ to $10^7$ Ω·cm . The resistance adjusting layer 08 is a layer for adjusting the resistance between the core material 06 and the surface of the charging roll 05, and has, for example, a thickness of 150 μm and a volume resistivity of about from $10^8$ to $10^9$ Ω·cm . They are formed in such a manner that the resistance in the radial direction of the elastic layer 07 is larger than that of the resistance adjusting layer 08.

Since the resistance adjusting layer 08 has a volume resistivity higher by at least $10^2$ Ω·cm than the elastic layer 07, the resistance between the core material 06 and the surface of the charging roll is determined by the resistance adjusting layer 08 even though the thickness thereof is small.

In FIG. 3, a contact region Q0 between the drum 01 of the photosensitive article and the charging roll 05 is a charging region for charging the drum 01 of the photosensitive article. The cylindrical member 02 comprising aluminum of the drum 01 of the photosensitive article is connected to the ground, and a voltage for charging from a power source E1 for the charging roll is applied to the core material 06 comprising aluminum of the charging roll 05. The power source E1 for the charging roll comprises a direct current power source E1*d* for charging and an alternating current power source E1*a* for charging.

As a material for forming the semiconductive elastic layer 07 and the resistance adjusting layer 08 of the charging roll 05, an ionic conductive material and an electronically conductive material have been known.

The charging roll comprising the ionic conductive material is described, for example, in Japanese Patent No. 2,649,163.

The charging member using an ionic conductive rubber described in this patent is produced by dispersing an ionic conductive agent in a rubber material, and the ionic conductive agent can be uniformly dispersed in the rubber material. Therefore, the volume resistivity of the resistance adjusting layer 08 of the charging roll 05 can be made uniform.

However, because the charging roll comprising the ionic conductive material suffers a large fluctuation in volume resistivity and in resistance between the core material and the surface due to an environmental fluctuation, such as fluctuations in temperature and humidity, the electric current flowing between the charging roll and the photosensitive article also suffers a large fluctuation associated with the fluctuation in resistance of the charging roll, and as a result, a problem occurs in that the fluctuation in charging potential of the photosensitive article becomes large.

A charging roll comprising the electronically conductive material suffers a small fluctuation in volume resistivity associated with the environmental fluctuation. However, it involves a problem in that it is difficult to uniformly disperse the electronically conductive filler (electronically conductive agent) in a rubber material, and thus the distribution of the volume resistivity becomes uneven. Furthermore, it also involves a problem in that the volume resistivity of the resistance adjusting layer 08 is changed by a fluctuation of an electric field applied.

FIG. 4 is a graph showing the general characteristics of the dependency of the volume resistivity on the electric field of a semiconductive layer (electronically conductive layer) comprising a resin or rubber having an electronically conductive filler dispersed therein.

In FIG. 4, the volume resistivity of the semiconductive layer having an electronic conductivity comprising a resin or rubber having an electronically conductive filler dispersed therein is decreased as the applied electric field is increased. Accordingly, as the voltage applied to the charging member is increased, the volume resistivity of the semiconductive layer of the charging member is decreased. Therefore, in the case where, for example, the charging member is a charging roll comprising a metallic core material having a semiconductive layer formed on the surface thereof, as the voltage applied to the charging member is increased, the resistance between the metallic core material and the surface of the semiconductive layer is decreased.

In FIG. 3, when the surface of the drum 01 of the photosensitive article is charged by the charging roll 05 using the conventional electronically conductive material subjected to constant-voltage control, since the resistance against the electric current flowing between the core material 06 and the cylindrical member 02 is large in the photosensitive layer 03, 90% or more of the electric field is generally applied to the photosensitive layer 03, and the electric field applied between the core material 06 and the contact region Q0 is only several percents.

For examples when the voltage of the direct current power source for charging E1*d* is E1*d*=740 V, and the peak-to-peak voltage of the alternating current power source for charging E1*a* is Vpp=1.8 kV, the maximum value Vm of the voltage applied between the core material 06 and the cylindrical member 02 is Vm=−740−(1,800/2)=−1,640 V.

In the case where 5% of the voltage of the direct current power source for charging E1*d*=−740 V is dropped in the resistance adjusting layer 08, the surface of the photosensitive layer 03 is charged at −740×95%=−703 V.

In the case where several percents (for example, 5%) of the Vm is applied between the core material 06 and the contact region Q0, the maximum voltage Vtm applied between the core material 06 and the contact region Q0 is as follows:

$$Vtm=1,640\times(5/100)=82\ V$$

However, when a defective part having a low resistance is present in the photosensitive layer 03 of the drum 01 of the photosensitive article due to inclusion of foreign matters, an excessive voltage is applied to a part of the resistance adjusting layer 08 that is in contact with the defective part.

Accordingly, the electric field of the region shown by A (region normally used) in FIG. 4 is applied to the part of the resistance adjusting layer 08 in contact with the normal part, which is different from the defective part, of the photosensitive layer 03, but the electric field of the region shown by B (region of contacting defective part) in FIG. 4 is applied to the part of the resistance adjusting layer 08 in contact with the defective part having a low resistance, so as to lower the volume resistivity.

An excessive electric field is applied to the resistance adjusting layer 08 in the region B of contacting the defective part in FIG. 4. At this time, the volume resistivity of the resistance adjusting layer 08 is largely changed (decreased) corresponding to the change in electric field applied, and thus leakage may occur due to insulation breakage of the resistance adjusting layer 08.

Particularly, in the case where the distribution of the volume resistivity of the resistance adjusting layer 08 is uneven, it involves a problem in that the leakage is liable to occur when a high electric field is applied to the part having a low volume resistivity of the resistance adjusting layer 08.

Therefore, as the electronically conductive material used in the resistance adjusting layer 08, such a material is preferred that suffers only a small change in volume resistivity irrespective of the fluctuation of the electric field.

However, the resistance adjusting layer 08 of the conventional electronic conductivity is largely dependent on the electric field, and thus has a problem in that the volume resistivity is decreased in the region of a high electric field (region B in FIG. 4).

Therefore, a resistance adjusting layer 08 having a high volume resistivity at a high electric field has not been employed, and it is the actual state that a resistance adjusting layer 08 having a volume resistivity of $1\times10^5$ Ωcm or less at a high electric field of $5\times10^4$ V/cm is employed.

SUMMARY OF THE INVENTION

An object of the invention is to provide a charging member in that generation of leakage at a high electric field due to a surface defect at a defective part (such as a flaw, a pinhole and a foreign matter) having a low resistance is prevented.

As a result of investigation by the inventors in view of the problems described above, it has been succeeded to form a semiconductive layer having a small decrease in volume resistivity under a high voltage. Consequently, a charging member has been able to be produced that having a semiconductive layer suffering a small fluctuation in resistance from a low voltage to a high voltage.

The invention relates to a charging member for charging an article to be charged by contacting with the surface of the article to be charged, the charging member comprising a conductive core material and a resistance adjusting layer for adjusting a resistance between the conductive core material and the surface of the article to be charged, formed on an outer periphery of the conductive core material, comprising a material for forming the resistance adjusting layer and a conductive filler for adjusting resistance that exhibits conductivity by electronic conduction, and having a volume resistivity of $5\times10^5$ Ω·cm or more at an electric field of $5\times10^4$ V/cm.

The resistance adjusting layer formed on the outer periphery of the conductive core material comprises a material for forming the resistance adjusting layer and a conductive filler for adjusting resistance exhibiting conductivity by electronic conduction, and adjusts the resistance between the conductive core and the surface of the charging member. The resistance adjusting layer has a volume resistivity of $5\times10^5$ Ω·cm or more at an electric field of $5\times10^4$ V/cm.

Because the conductive filler for adjusting resistance exhibiting conductivity by electronic conduction suffers a small change in resistance due to an environmental fluctuation (temperature and humidity environment), the charging potential of the article to be charged can be easily controlled even when an environmental fluctuation occurs, and thus uniform charging of the article to be charged can be easily conducted.

Furthermore, since the resistance adjusting layer according to the invention has a high volume resistivity at a high electric field, insulation breakage and leakage are difficult to occur even when the resistance adjusting layer is in contact with a defective part having a low resistance of the article to be charged (for example, a photosensitive article) and a high voltage is applied to the part of the resistance adjusting layer in contact with the defective part.

DESCRIPTION OF PREFERRED EMBODIMENTS

In the charging member, the resistance adjusting layer has a volume resistivity of from $2\times10^{11}$ to $5\times10^5$ Ω·cm at an electric field of from 1×10 to $5\times10^4$ V/cm.

The resistance adjusting layer has a volume resistivity of $5\times10^5$ Ω·cm or more at a high electric field of $5\times10^4$ V/cm, which is of a low dependency on the electric field, and thus decrease in volume resistivity at a high electric field is small. Such a resistance adjusting layer can be produced by uniformly dispersing an electronically conductive filler in a material for forming the resistance adjusting layer, such as rubber and a resin.

In the case where the volume resistivity is in the range of from $2\times10^{11}$ to $5\times10^5$ Ω·cm within the range of from a low electric field ($1\times10^1$ V/cm) to a high electric field ($5\times10^4$ V/cm), the volume resistivity at the low electric field is $2\times10^{11}$ Ω·cm.

In this case, the volume resistivity of the resistance adjusting layer at a low electric field is the same as the conventional product, and when the charging member is used at a low electric field (i.e., in contact with the normal part of the article to be charged), a power source for charging having the same voltage as the conventional product can be used.

Accordingly, because the resistance adjusting layer of Embodiment 1 exhibits a small change in resistance between a low electric field and a high electric field, the article to be charged can be charged to an appropriate charging potential without using a high voltage power source.

Figure 4:
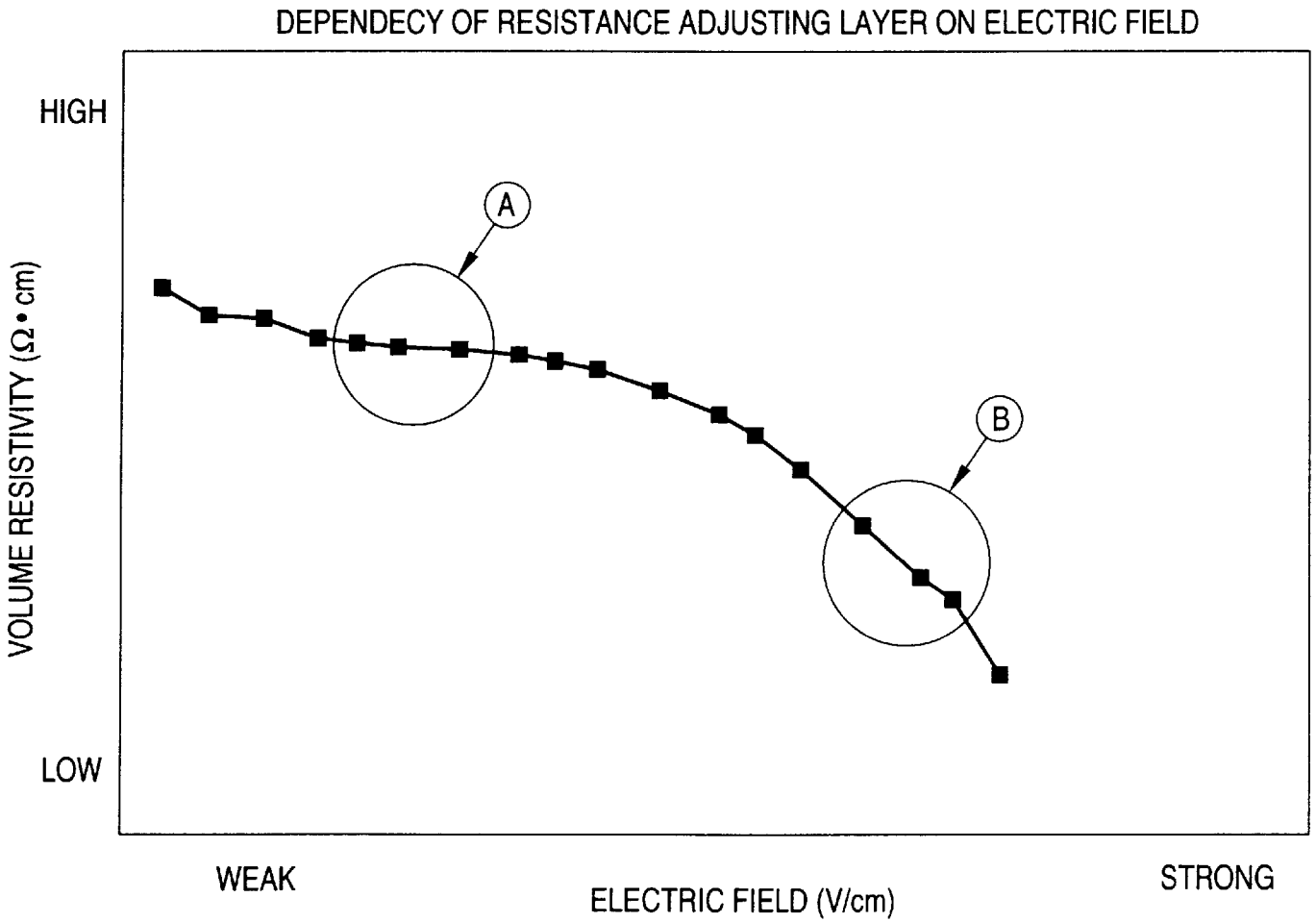
FIG. 4 is a graph showing general characteristics of the dependency of the volume resistivity on the electric field of a semiconductive layer (electronically conductive layer) comprising a resin or rubber having an electronically conductive filler dispersed therein.

When a material having a high volume resistivity at the high electric field (region B in FIG. 4) is used in the resistance adjusting layer, the leakage occurring at a high electric field can be prevented. Furthermore, it does not exhibit a high volume resistance in the region normally used (region A in FIG. 4).

In other words, even when a material having a high volume resistivity at a high electric field (region B in FIG. 4) is used in the resistance adjusting layer, since the volume resistivity at a low electric field (region A in FIG. 4) is not so high, the voltage drop in the resistance adjusting layer at a low electric field (region A in FIG. 4) does not become large. Therefore, even when the thickness of the resistance adjusting layer and the voltage of the direct current power source for charging E1*d* are the same as in the conventional technique, the charging potential of the surface of the article to be charged (photosensitive layer) in a low electric field (region A in FIG. 4) is not decreased.

Therefore, the decrease in charging potential on the surface of the article to be charged can be prevented without using a high voltage power source as the direct current power source for charging, and thus increase in production cost can be prevented. That is, the surface of the article to be charged can be charged at an appropriate charging potential between a low electric field (region A in FIG. 4 normally used) and a high electric field (region B in FIG. 4) by using a direct current power source for charging having the same voltage as in the conventional technique and by using the resistance adjusting layer having the same thickness as in the conventional technique.

Because the volume resistivity of the resistance adjusting layer at a low electric field (region A in FIG. 4) is not increased even by using the resistance adjusting layer having a high volume resistivity at a high electric field (region B in FIG. 4) and by using a direct current power source for charging having the same voltage as in the conventional technique, the surface of the article to be charged can be charged to an appropriate charging potential without decreasing the thickness of the resistance adjusting layer. Because there is no necessity to decrease the thickness of the resistance adjusting layer, it becomes possible to prevent the leakage due to insulation breakage at a high electric field (region B in FIG. 4).

Because the leakage does not occur, the problems can be eliminated in that the surface of the article to be charged in the vicinity of the part, at which the leakage occurs, is not charged when the leakage occurs, and the part, at which the leakage occurs, is deteriorated to shorten the service life.

Accordingly, a charging member exhibiting a small fluctuation in volume resistivity due to a fluctuation in environment and electric field can be provided in this embodiment.

Furthermore, a charging member that can suppress generation of leakage due to a surface defect of an article not to be charged (such as an image supporting article having a photosensitive surface) can be provided.

Furthermore, the fluctuation in charging potential of the article to be charged, such as a photosensitive article, can be suppressed by suppressing the fluctuation in resistance of the charging member due to the environment and the voltage applied, and at the same time, the uniformity of charging can be improved.

The charging member may further comprises a conductive elastic layer formed on a surface of the conductive core material. In this case, an appropriate elasticity can be given to the surface of the resistance adjusting layer by the conductive elastic layer formed on the surface of the conductive core material.

The conductive elastic layer has a single layer structure and a hardness of from 25° to 50° as measured by ASKER C hardness meter. In this case, since the conductive elastic layer has a single layer structure, the number of the production steps is small, and thus the production cost can be suppressed at a low level. Furthermore, since the hardness thereof is from 25° to 50° as measured by ASKER C hardness meter, an appropriate elasticity can be given to the surface of the charging member (i.e., an elasticity for realizing appropriate conditions of contacting with the article to be charged) by making the thickness thereof to be about 2 mm.

The conductive filler may be carbon black having a pH of 4.0 or less. Because carbon black having a pH of 4.0 or less (electronically conductive filler) exhibits good dispersibility in a material for forming the resistance adjusting layer, scatter of the resistance of the resistance adjusting layer can be made small.

When the scatter of the resistance of the resistance adjusting layer becomes small, local insulation breakage of the resistance adjusting layer due to electric current concentration on application of a high voltage becomes difficult to occur. It also becomes easy to uniformly charge the article to be charged.

Furthermore, since the fluctuation in resistance of the carbon black (electronically conductive filler) due to environmental fluctuation (temperature and humidity environment) is small, the charging potential can be easily controlled even when the environmental fluctuation occurs, and it is also easy to uniformly charge the article to be charged. The conductive filler is carbon fluoride or tin oxide.

The material for forming the resistance adjusting layer may be a polyurethane resin. When the resistance adjusting layer is formed with a hard resin, a wrinkle and a crack are liable to be formed on formation thereof. However, since a polyurethane resin is relatively soft, the shape of the contact region (nip), at which the charging member and the article to be charged are in contact with each other with pressure, becomes appropriate, and a polyurethane resin is excellent in wear resistance.

The conductive elastic layer may comprises a molded article of conductive liquid silicone rubber and has a volume resistivity of $1\times10^7$ Ω·cm at an electric field of 10 V/cm. In order to endow conductivity to rubber, carbon is generally added. However, in the case where carbon is added, there is a problem in that the hardness of the rubber is increased. By using the conductive liquid silicone rubber, both the conductivity and the low hardness can be realized.

In the case where the volume resistivity of the conductive elastic layer is small, influence of the scatter of the volume resistivity can be made small, and thus the article to be charged can be easily charged uniformly.

The invention will be described in more detail with reference to specific examples, but the invention is not construed as being limited to the examples.

EXAMPLE 1

Figure 1:
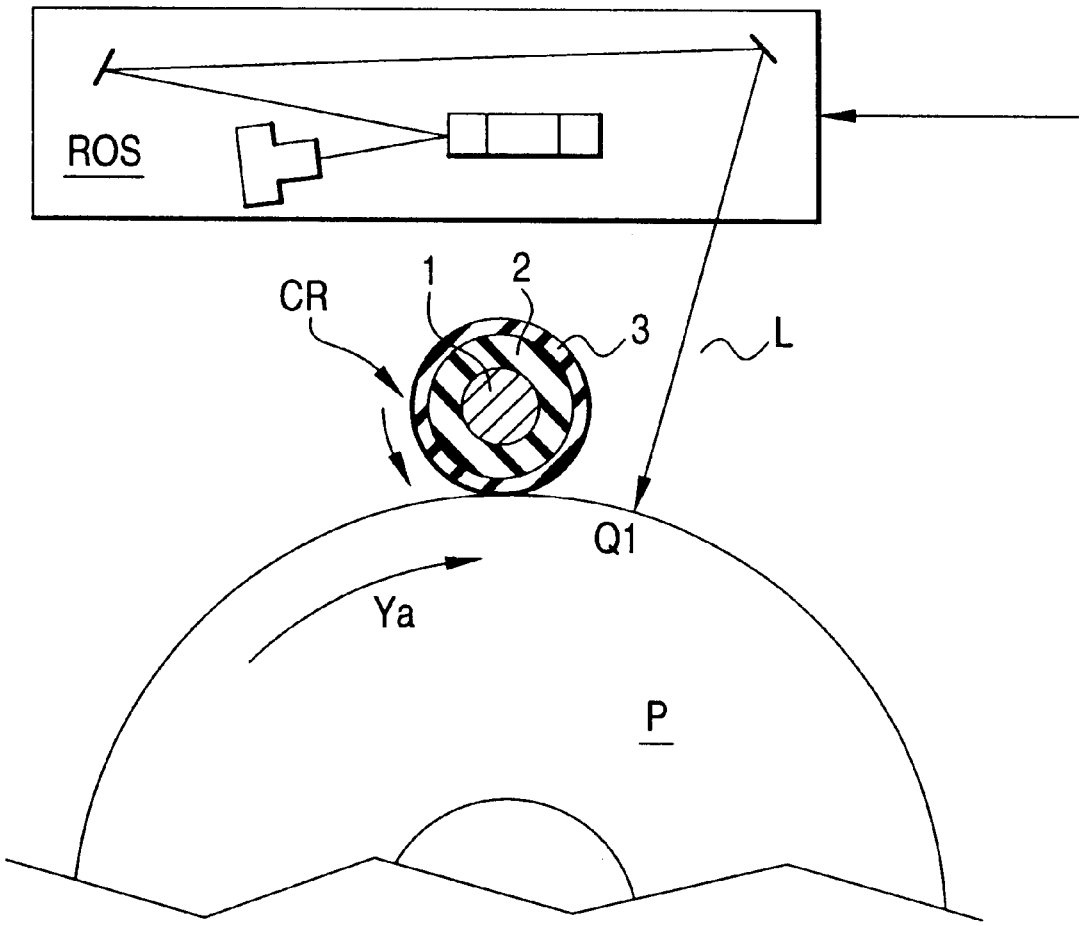
FIG. 1 is a schematic diagram showing a charging roll (charging member) of Example 1 according to the invention.

FIG. 1 is a schematic diagram showing a charging roll (charging member) of Example 1 according to the invention.

In FIG. 1, the surface of an image carrier P rotating in the direction shown by the arrow Ya is uniformly charged by a charging roll CR, and then a static charge latent image is written at a position Q1, at which the latent image is written, by a laser beam L emitted from an ROS (latent image writing apparatus).

The charging roll CR comprises a conductive core material 1 having a conductive elastic layer 2 formed on the surface of the core material 1, and a resistance adjusting layer 3 formed on the surface of the conductive elastic layer 2.

The resistance adjusting layer 3 comprises a material for forming the resistance adjusting layer and a conductive filler for adjusting resistance that exhibits conductivity by electronic conduction.

The charging roll CR is produced in the following manner.

Conductive liquid silicone rubber (SCL-1506AB produced by Dow Corning Toray Silicone Co., Ltd.) was injection-molded on a core metal having a diameter of 8 mm to obtain a molded article having a thickness of 4 mm. The molded article had a hardness of 40° as measured by ASKER C hardness test and a volume resistivity of $1\times10^5$ Ω·cm at an electric field of 10 V/cm. 40 parts by weight of acidic carbon black of pH 2.0 (Monarch 1000 produced by Cabot Corp., U.S.A.) and 100 parts by weight of MEK were added to 100 parts by weight of a solution of a polyurethane resin in toluene and MEX (Nippollan 3113 produced by Nippon Polyurethane Co., Ltd.), and they were mixed with a ball mill to obtain a dispersion. The dispersion was applied on the molded article of the silicone rubber by a roll coater to obtain a coated film having a dry thickness of 100 μm.

The resistivity of the sole coated film was from $6\times10^8$ to $3\times10^6$ Ω·cm at an electric field of from $1\times10^1$ to $5\times10^4$ V/cm. The charging roll thus obtained was installed in a color duplicator (Acolor 635 produced by Fuji Xerox Co., Ltd.) to conduct a printing durability test. The nip forming property with the image carrier (photosensitive article) was good, and a clear full-color image was obtained after printing 200,000 sheets, but neither image defect due to charging unevenness and leakage nor fluctuation in image density due to environmental fluctuation was observed.

EXAMPLE 2

The structure of a charging roll of Example 2 comprises, as similar to the charging roll CR shown in FIG. 1, a conductive core material 1, a conductive elastic layer 2 and a resistance adjusting layer 3, and is produced in the following manner. 50 parts by weight of tin oxide (S-1 produced by Mitsubishi Materials Co., Ltd.) and 100 parts by weight of MEK were added to 100 parts by weight of a solution of a polyurethane resin in toluene and MEK (Nippollan 3303 produced by Nippon Polyurethane Co., Ltd.), and they were mixed with a ball mill to obtain a dispersion. The dispersion was coated on the molded article of the silicone rubber described in Example 1 by a roll coater to obtain a coated film having a dry thickness of 130 The resistivity of the sole coated film was from $4\times10^9$ to $8\times10^6$ Ω·cm at an electric field of from $1\times10^1$ to $5\times10^4$ V/cm.

The charging roll thus obtained was installed in a color duplicator (Acolor 635 produced by Fuji Xerox Co., Ltd.) to conduct a printing durability test. The nip forming property with the photosensitive article was good, and a clear full-color image was obtained after printing 200,000 sheets, but neither image defect due to charging unevenness and leakage nor fluctuation in image density due to environmental fluctuation was observed.

EXAMPLE 3

The structure of a charging roll of Example 3 comprises, as similar to the charging roll CR shown in FIG. 1, a conductive core material 1, a conductive elastic layer 2 and a resistance adjusting layer 3, and is produced in the following manner.

Conductive liquid silicone rubber (SCL-AB produced by Dow Corning Toray Silicone Co., Ltd.) was injection-molded on a core metal having a diameter of 8 mm to obtain a molded article having a thickness of 4 mm. The molded article had a hardness of 25° as measured by ASKER C hardness test and a volume resistivity of $1\times10^7$ Ω·cm at an electric field of 10 V/cm. 30 parts by weight of tin oxide doped with antimony (T-1 produced by Mitsubishi Materials Co., Ltd.) and 100 parts by weight of MEK were added to 100 parts by weight of a polyurethane resin solution (Nippollan 3113 produced by Nippon Polyurethane Co., Ltd.), and the mixture was agitated with a paint shaker to obtain a dispersion. The dispersion was applied on the molded article of the silicone rubber by a roll coater to obtain a coated film having a dry thickness of 100 μm.

The resistivity of the sole coated film was from $1\times10^8$ to $5\times10^5$ Ω·cm at an electric field of from $1\times10^1$ to $5\times10^4$ V/cm.

The charging roll thus obtained was installed in a color duplicator (Acolor 635 produced by Fuji Xerox Co., Ltd.) to conduct a printing durability test. The nip forming property with the photosensitive article was good, anda clear full-color image was obtained after printing 200,000 sheets, but neither image defect due to charging unevenness and leakage nor fluctuation in image density due to environmental fluctuation was observed.

EXAMPLE 4

The structure of a charging roll of Example 4 comprises, as similar to the charging roll CR shown in FIG. 1, a conductive core material 1, a conductive elastic layer 2 and a resistance adjusting layer 3, and is produced in the following manner.

10 parts by weight of carbon fluoride (Accufluor 2028 produced by Allied Signal Corp.) and 100 parts by weight of MEK were added to 100 parts by weight of a solution of a polyurethane resin in toluene and MEK (Nippollan 3113 produced by Nippon Polyurethane Co., Ltd.), and the mixture was agitated with a ball mill to obtain a dispersion. The dispersion was applied on the molded article of the silicone rubber described in Example 1 by a roll coater to obtain a coated film having a dry thickness of 100 $\mu$m.

The resistivity of the sole coated film was from $2\times10^{10}$ to $1\times10^{7}$ Ω·cm at an electric field of from $1\times10^{1}$ to $5\times10^{4}$ V/cm.

The charging roll thus obtained was installed in a color duplicator (Acolor 635 produced by Fuji Xerox Co., Ltd.) to conduct a printing durability test. The nip forming property with the photosensitive article was good, and a clear full-color image was obtained after printing 200,000 sheets, but neither image defect due to charging unevenness and leakage nor fluctuation in image density due to environmental fluctuation was observed.

COMPARATIVE EXAMPLE 1

The structure of a charging roll of Comparative Example 1 comprises, as similar to the charging roll CR shown in FIG. 1, a conductive core material 1, a conductive elastic layer 2 and a resistance adjusting layer 3, and is produced in the following manner.

Conductive liquid silicone rubber (SCL-1506AB produced by Dow Corning Toray Silicone Co., Ltd.) was injection-molded on a core metal having a diameter of 8 mm to obtain a molded article having a thickness of 4 mm. The molded article had a hardness of 400 as measured by ASKER C hardness test and a volume resistivity of $1\times10^{5}$ Ω·cm at an electric field of 10 V/cm. 13 parts by weight of neutral carbon black having pH 8.5 (Vulcan XC72R produced by Cabot Corp.) and 100 parts by weight of MEK were added to 100 parts by weight of a polyurethane resin solution (Nippollan 3113 produced by Nippon Polyurethane Co., Ltd.), and the mixture was agitated with a ball mill to obtain a dispersion. The dispersion was applied on the molded article of the silicone rubber by a roll coater to obtain a coated film having a dry thickness of 100 $\mu$m.

The resistivity of the sole coated film was from $2\times10^{7}$ to $3\times10^{3}$ Ω·cm at an electric field of from $1\times10^{1}$ to $5\times10^{4}$ V/cm.

The charging roll thus obtained was installed in a color duplicator (Acolor 635 produced by Fuji Xerox Co., Ltd.) to conduct a printing durability test. While the nip forming property with the photosensitive article was good, leakage was observed at the initial stage of the test.

COMPARATIVE EXAMPLE 2

The structure of a charging roll of Comparative Example 2 comprises, as similar to the charging roll CR shown in FIG. 1, a conductive core material 1, a conductive elastic layer 2 and a resistance adjusting layer 3, and is produced in the following manner.

Conductive liquid silicone rubber (produced by Dow Corning Toray Silicone Co., Ltd.) was injection-molded on a core metal having a diameter of 8 mm to obtain a molded article having a thickness of 4 mm. The molded article had a hardness of 60° as measured by ASKER C hardness test and a volume resistivity of $1\times10^{5}$ Ω·cm at an electric field of 10 V/cm. 40 parts by weight of acidic carbon black having pH 2.0 (Monarch 800 produced by Cabot Corp.) and 100 parts by weight of MEK were added to 100 parts by weight of a polyurethane resin solution (Nippollan 3113 produced by Nippon Polyurethane Co., Ltd.), and the mixture was agitated with a ball mill to obtain a dispersion. The dispersion was applied on the molded article of the silicone rubber by a roll coater to obtain a coated film having a dry thickness of 100 $\mu$m.

The resistivity of the sole coated film was from $6\times10^{8}$ to $7\times10^{4}$ Ω·cm at an electric field of from $1\times10^{1}$ to $5\times10^{4}$ V/cm.

The charging roll thus obtained was installed in a color duplicator (Acolor 635 produced by Fuji Xerox Co., Ltd.) to conduct a printing durability test. The nip forming property with the photosensitive article was poor, and an image defect as unevenness in image density due to charging unevenness was observed.

Figure 2:
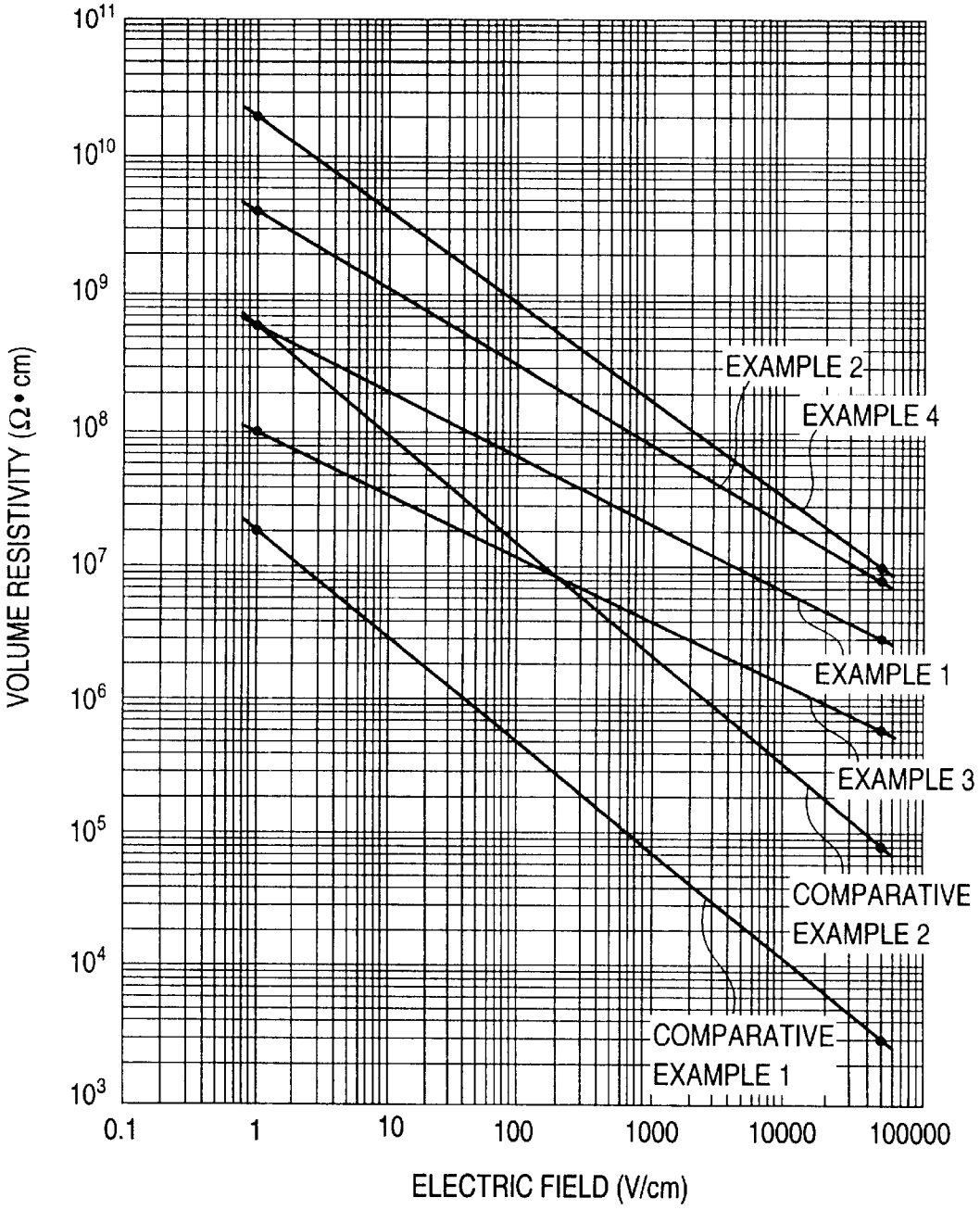
FIG. 2 is a graph showing the change in volume resistivity depending on the change in electric field applied to the semiconductive layer of the charging roll (i.e., the voltage applied to the charging roll) for Examples 1 to 4 and Comparative Examples 1 and 2.
Figure 3:
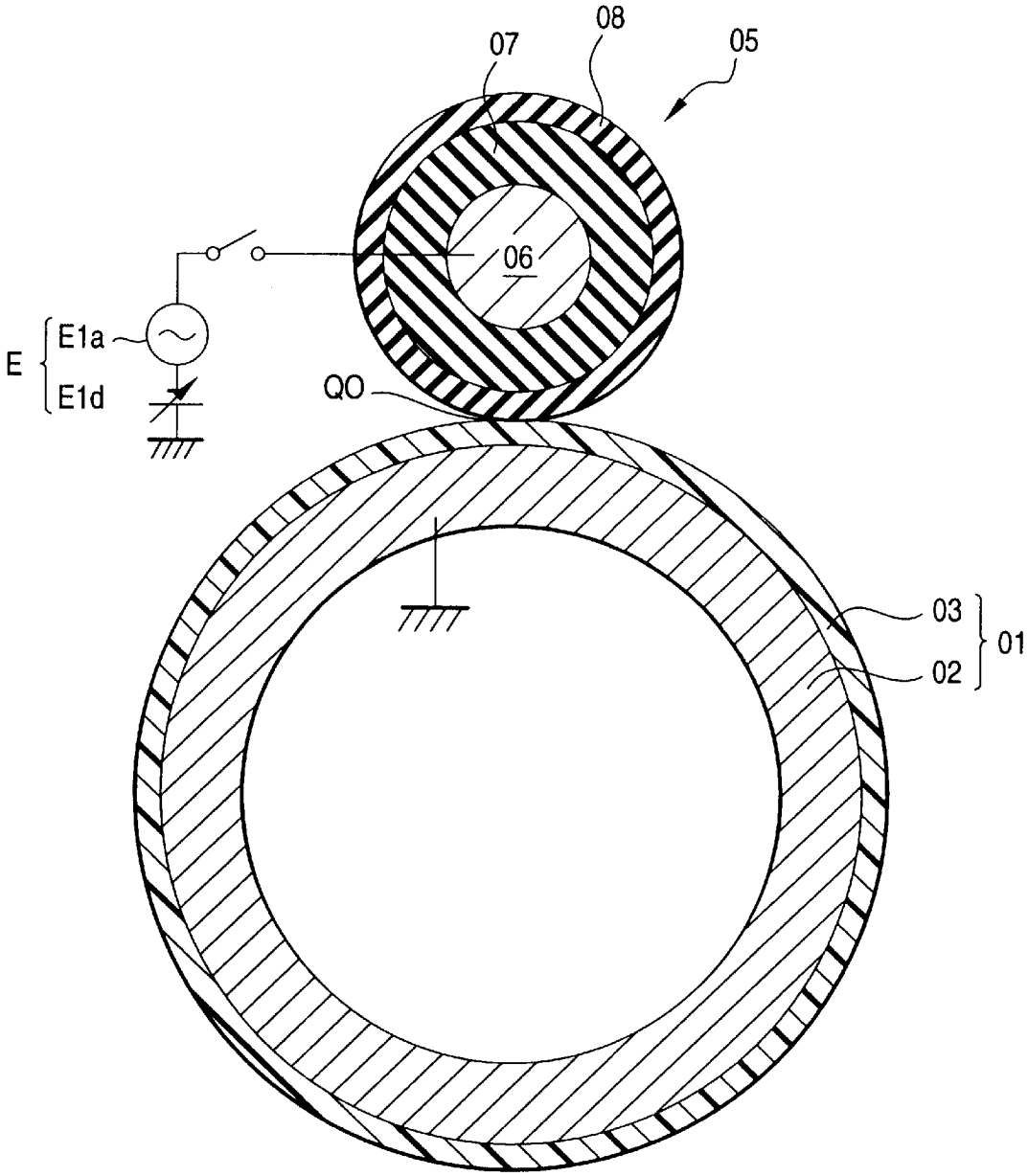
FIG. 3 is a schematic diagram showing a charging roll for charging a surface of a photosensitive article by a contact charging method.

FIG. 2 is a graph showing the change in volume resistivity depending on the change in electric field applied to the semiconductive layer of the charging roll CR (i.e., the voltage applied to the charging roll) in Examples 1 to 4 and Comparative Examples 1 and 2.

In FIG. 2, the charging roll according to the invention in Examples 1 to 4 exhibits a small decrease in resistance at a high electric field. Therefore, since a stable resistance value can be maintained on application of a high voltage, stable charging can be conducted under the whole voltage range from a low voltage to a high voltage.

That is, the charging roll CR according to the invention in Examples 1 to 4 has a resistance adjusting layer 3 having a volume resistivity of from $2\times10^{11}$ to $5\times10^{5}$Ω·cm at an electric field of from $1\times10^{1}$ to $5\times10^{4}$ V/cm. The resistance adjusting layer 3 exhibits a volume resistivity equivalent to the conventional product at a low electric field (an electric field applied on contacting the normal surface of the photosensitive article without defect), and the volume resistivity at a high electric field (an electric field applied on contacting the defective part having a low resistance on the surface of the photosensitive article) is $5\times10^{5}$ Ω·cm or more, which is higher than the conventional product. Accordingly, the leakage at high electric field is difficult to occur. Therefore, an image with good quality having less image defect due to leakage can be obtained in Examples 1 to 4.

While the invention has been described in detail with reference to the examples, the invention is not construed as being limited to the examples, and various changes can be made within the range of the substance of the invention described herein.

For example, the invention can be applied to a charging roll having a single layer structure instead of the charging roll comprising the semiconductive layer having the two-layer structure formed on the outer periphery of the core material.

The invention may also be applied to charging member of a contact type other than a charging roll.

As described in the foregoing, the invention provides a charging member that is prevented from generation of leakage at a high electric field.

What is claimed is:

1. A charging member for charging an article to be charged by contacting with the surface of said article to be charged, said charging member comprising:

a conductive core material and a resistance adjusting layer for adjusting a resistance between said conductive core material and said surface of said article to be charged, formed on an outer periphery of said conductive core material, comprising a material for forming said resistance adjusting layer and a conductive filler for adjusting resistance that exhibits conductivity by electronic conduction, and having a volume resistivity of $5\times10^5$ Ω·cm or more at an electric field of $5\times10^4$ V/cm.

2. A charging member as claimed in claim 1, wherein said resistance adjusting layer has a volume resistivity of from $2\times10^{11}$ to $5\times10^5$ Ω·cm at an electric field of from $1\times10^1$ to $5\times10^4$ V/cm.

3. A charging member as claimed in claim 1, wherein said charging member further comprises a conductive elastic layer formed on a surface of said conductive core material.

4. A charging member as claimed in claim 2, wherein said charging member further comprises a conductive elastic layer formed on a surface of said conductive core material.

5. A charging member as claimed in claim 3, wherein said conductive elastic layer has a hardness of from 25° to 50° as measured by ASKER C hardness test.

6. A charging member as claimed in claim 5, wherein said conductive elastic layer has a single layer structure.

7. A charging member as claimed in claim 1, wherein said conductive filler is carbon black having a pH of 4.0 or less.

8. A charging member as claimed in claim 1, wherein said conductive filler comprising tin oxide.

9. A charging member as claimed in claim 1, wherein said material for forming said resistance adjusting layer is a polyurethane resin.

10. A charging member as claimed in claim 3, wherein said conductive elastic layer comprises a molded article of conductive liquid silicone rubber.

11. A charging member as claimed in claim 10, wherein said conductive elastic layer has a volume resistivity of $1\times10^7$ Ω·cm at an electric field of 10 V/cm.

12. A charging apparatus for charging an article to be charged by contacting with the surface of said article to be charged, said charging apparatus comprising:

a conductive core material, a resistance adjusting layer for adjusting a resistance between said conductive core material and said surface of said article to be charged, formed on an outer periphery of said conductive core material, comprising a material for forming said resistance adjusting layer and a conductive filler for adjusting resistance that exhibits conductivity by electronic conduction, and having a volume resistivity of $5\times10^5$ Ω·cm or more at an electric field of $5\times10^4$ V/cm, and a voltage applying apparatus for applying a voltage to said conductive core material.

13. A charging apparatus as claimed in claim 12, wherein said resistance adjusting layer has a volume resistivity of from $2\times10^{11}$ to $5\times10^5$ Ω·cm at an electric field of from $1\times10^1$ to $5\times10^4$ V/cm.

14. A charging apparatus as claimed in claim 12, wherein said charging apparatus further comprises a conductive elastic layer formed on a surface of said conductive core material.

15. A charging apparatus as claimed in claim 13, wherein said charging member further comprises a conductive elastic layer formed on a surface of said conductive core material.

16. A charging apparatus as claimed in claim 14, wherein said conductive elastic layer has a hardness of from 25° to 50° as measured by ASKER C hardness test.

17. A charging apparatus as claimed in claim 14, wherein said conductive elastic layer has a single layer structure.

18. A charging apparatus as claimed in claim 12, wherein said conductive filler comprising carbon black having a pH of 4.0 or less.

19. A charging apparatus as claimed in claim 12, wherein said conductive filler consists of tin oxide.

20. A charging apparatus as claimed in claim 12, wherein said material for forming said resistance adjusting layer is a polyurethane resin.

* * * * *